US008371469B2

(12) United States Patent
Takedutsumi et al.

(10) Patent No.: US 8,371,469 B2
(45) Date of Patent: Feb. 12, 2013

(54) FLUID CONTAINER INCLUDING EXTERNAL CONTAINER AND SPOUT-EQUIPPED PACKAGING BAG WITHIN EXTERNAL CONTAINER

(75) Inventors: Toshiki Takedutsumi, Kanagawa (JP); Toru Hasegawa, Kanagawa (JP); Kiyotaka Irie, Fukuoka (JP); Shigeru Takeshita, Fukuoka (JP)

(73) Assignee: Tokyo Ohka Kogyo Co., Ltd., Kawasaki-shi (JP)

( * ) Notice: Subject to any disclaimer, the term of this patent is extended or adjusted under 35 U.S.C. 154(b) by 680 days.

(21) Appl. No.: 12/306,094

(22) PCT Filed: Jun. 25, 2007

(86) PCT No.: PCT/JP2007/062673

§ 371 (c)(1),
(2), (4) Date: Feb. 5, 2009

(87) PCT Pub. No.: WO2008/001711

PCT Pub. Date: Jan. 3, 2008

(65) Prior Publication Data

US 2009/0230132 A1 Sep. 17, 2009

(30) Foreign Application Priority Data

Jun. 28, 2006 (JP) ..... 2006-178810

(51) Int. Cl.
*B65D 25/16* (2006.01)
*B65D 35/14* (2006.01)
*B65D 90/64* (2006.01)

(52) U.S. Cl. ..... 220/495.05; 220/495.03; 220/592.19

(58) Field of Classification Search ..... 220/495.01, 220/495.03, 495.06, 592.19
See application file for complete search history.

(56) References Cited

U.S. PATENT DOCUMENTS

| | | | | | |
|---|---|---|---|---|---|
| 3,690,524 | A | * | 9/1972 | Haberhauer | 222/573 |
| RE27,626 | E | * | 4/1973 | Johnston | 222/400.7 |
| 3,765,144 | A | * | 10/1973 | Schiesser | 53/412 |
| 4,076,147 | A | * | 2/1978 | Schmit | 222/89 |
| 4,330,066 | A | * | 5/1982 | Berliner | 215/12.1 |
| 4,457,455 | A | * | 7/1984 | Meshberg | 222/105 |
| 4,561,110 | A | * | 12/1985 | Herbert | 604/408 |
| 4,732,299 | A | * | 3/1988 | Hoyt | 222/94 |

(Continued)

FOREIGN PATENT DOCUMENTS

| | | |
|---|---|---|
| CN | 1213912 | 8/2005 |
| JP | H05-505372 | 8/1993 |

(Continued)

OTHER PUBLICATIONS

12306094—JP10-218236_PAJ-Machine-Translation.*

(Continued)

*Primary Examiner* — J. Gregory Pickett
*Assistant Examiner* — Ned A Walker
(74) *Attorney, Agent, or Firm* — Knobbe Martens Olson & Bear LLP

(57) ABSTRACT

A fluid container having an external container including an opening portion and a spout-equipped packaging bag used as the inner bag of the external container and having the spout joined to a packaging bag body which is receivable in the external container (20). The spout is attachable to and detachable from the opening portion of the external container.

15 Claims, 7 Drawing Sheets

U.S. PATENT DOCUMENTS

| | | | | | |
|---|---|---|---|---|---|
| 4,736,926 | A * | 4/1988 | Fallon et al. | 251/149.9 |
| 4,785,973 | A * | 11/1988 | Kobe | 222/82 |
| 5,046,634 | A | 9/1991 | McFarlin et al. | |
| 5,108,015 | A * | 4/1992 | Rauworth et al. | 222/400.7 |
| 5,335,821 | A * | 8/1994 | Osgar | 222/83 |
| 5,435,460 | A * | 7/1995 | Osgar | 222/1 |
| 5,526,956 | A * | 6/1996 | Osgar | 222/83 |
| 5,911,340 | A * | 6/1999 | Uematsu | 222/92 |
| 5,957,328 | A * | 9/1999 | Osgar | 222/1 |
| 5,971,019 | A * | 10/1999 | Imai | 137/614.04 |
| 6,000,848 | A * | 12/1999 | Massioui | 383/80 |
| 6,015,068 | A * | 1/2000 | Osgar et al. | 222/400.7 |
| 6,050,451 | A * | 4/2000 | Hess et al. | 222/92 |
| 6,079,597 | A * | 6/2000 | Rauworth et al. | 222/400.7 |
| 6,142,341 | A * | 11/2000 | Uematsu | 222/92 |
| 6,237,809 | B1 * | 5/2001 | Kawai et al. | 222/95 |
| 6,302,148 | B1 * | 10/2001 | Imai | 137/614.04 |
| 6,505,863 | B2 * | 1/2003 | Imai | 285/316 |
| 6,612,466 | B1 | 9/2003 | Malin | |
| 6,634,396 | B2 * | 10/2003 | Ozawa | 141/326 |
| 6,958,033 | B1 * | 10/2005 | Malin | 493/102 |
| 7,819,381 | B2 * | 10/2010 | Abe | 251/144 |
| 2001/0017998 | A1 * | 8/2001 | Terazawa et al. | 399/262 |
| 2008/0272323 | A1 * | 11/2008 | Abe | 251/149.1 |
| 2009/0020176 | A1 * | 1/2009 | Hasegawa et al. | 137/614.05 |
| 2009/0184133 | A1 * | 7/2009 | Hasegawa et al. | 222/95 |

FOREIGN PATENT DOCUMENTS

| | | | |
|---|---|---|---|
| JP | H-06-100087 | | 4/1994 |
| JP | H09-095565 | | 4/1997 |
| JP | 10-086953 | | 4/1998 |
| JP | H10-218236 | | 8/1998 |
| JP | 2000-128236 | | 5/2000 |
| JP | 2002-211589 | | 7/2002 |
| JP | 2002-225940 | | 8/2002 |
| JP | 3464232 | | 8/2003 |
| JP | 2003-246330 | | 9/2003 |
| JP | 2003-305107 | | 10/2003 |
| JP | 2004-123099 | | 4/2004 |
| JP | 2004-359333 | | 12/2004 |
| TW | 537910 | B | 6/2003 |
| TW | 232171 | B | 5/2005 |
| TW | 233007 | B | 5/2005 |

OTHER PUBLICATIONS

12306094—JP2004-123099_PAJ-Machine-Translation.*

12306094—JP10-218236 PAJ-Machine-Translation, Aug. 1998, Translated Apr. 4, 2012.*

12306094—JP2004-123099 PAJ-Machine-Translation, Apr. 2004, Translated Apr. 4, 2012.*

Notice of Reasons for Rejection issued in corresponding Taiwanese Patent Application No. 096123377, mailed Nov. 5, 2009.

Notice of Reasons for Rejection issued to Chinese Application No. 200780023369.2, mailed Mar. 24, 2010.

Notice of Reasons for Rejection issued in counterpart Korean Patent Application No. 10-2008-7031454, mailed Nov. 12, 2010.

Notice of Reasons for Rejection in corresponding Japanese Patent Application No. 2006-178810 dated Oct. 4, 2011.

* cited by examiner

PRIOR ART

FLUID CONTAINER INCLUDING EXTERNAL CONTAINER AND SPOUT-EQUIPPED PACKAGING BAG WITHIN EXTERNAL CONTAINER

RELATED APPLICATIONS

This application is the U.S. National Phase filing under 35 U.S.C. §371 of PCT/JP2007/062673, filed Jun. 25, 2007, which designated the United States and was published in a language other than English, which claims priority under 35 U.S.C. §119(a)-(d) to Japanese Patent Application No. 2006-178810, filed on Jun. 28, 2006. The content of these applications is incorporated herein by reference in their entireties.

TECHNICAL FIELD

The present invention relates to a fluid container for storing and transporting fluid content in such technical fields as industrial chemicals, medical supplies and cosmetic raw materials. Particularly, the present invention relates to a fluid container in which a spout-equipped packaging bag is accommodated in an external container.

BACKGROUND ART

Conventionally, in such technical fields as industrial chemicals, medical supplies and cosmetic raw materials, a container is used for storage and transportation, the container accommodating a spout-equipped packaging bag, which is used for accommodating fluid content, inside an external container that is made of aluminum, steel, stainless steel, fiber-board and the like.

Such a container can be reused simply by taking out the used packaging bag from the external container and setting a new packaging bag into the external container. This leads to an advantage, for example, in that there is no need for washing as compared to cases of directly filling fluid content into an external container such as one made of steel without using a packaging bag. Accordingly, such a container is widely used as a container for industrial chemicals, medical supplies and cosmetic raw materials (for example, see Patent Documents 1 and 2).

The container disclosed in Patent Document 1 has an inner bag for accommodating a high purity chemical inside an external container, in which the external container is provided with an opening portion for filling and dispensing the high purity chemical and an opening portion for filling with a pressure regulation fluid, the inner bag is configured with an inner bag body and an inlet/outlet port for the high purity chemical, the inlet/outlet port is provided in communication with the opening portion of the rigid external container, an inner pipe is inserted from the outside of the inner bag for filling and discharging the high purity chemical, and stoppers are respectively fitted in the two opening portions with handles.

The inner bag disclosed in Patent Document 1 is made from a configuration that the inlet/outlet port is equipped on the inner bag body which is manufactured by cutting a cylindrical film to a predetermined length, which is manufactured by using an inflation molding machine, and a hole is made in the periphery of the cylindrical film that has been cut into a predetermined length, an inlet/outlet port passes through the hole, and fixation is performed at a bottom mounting ring portion by heat sealing.

In addition, similarly to the case of Patent Document 1, in the container disclosed in Patent Document 2, a packaging bag is equipped with a mounting member inside an external container (a metal drum in Patent Document 2), the mounting member is inserted into a bunghole that is made by cutting out (perforating) a first closure, and is attached to the first closure by use of a threaded ring or the like, and thereafter, is mounted to the metal drum main body.

As shown in FIG. 7, the inner bag disclosed in Patent Document 1 and the packaging bag disclosed in Patent Document 2 are provided with a periphery edge circumference that is heat-sealed to form a heat seal portion 501, a hole that is formed on a portion of the surface of the bag, the portion being off the center of the inner bag (or packaging bag) 500 and being closer to one short side of the bag, an inlet/outlet port (or mounting member) that is inserted into the hole, and are heat-sealed at a bottom mounting ring 503 provided at the bottom of the inlet/outlet port (or mounting member), thereby attaching thereto.

Patent Document 1: Japanese Unexamined Patent Application Publication No. H09-95565

Patent Document 2: Japanese Unexamined Patent Application Publication No. H05-505372

DISCLOSURE OF THE INVENTION

Problems to be Solved by the Invention

However, the container of Patent Document 1 has a structure in which the inlet/outlet port is inserted into the opening portion of the exterior container, and the inlet/outlet port is supported at the opening portion by some fixing means; in addition, the container of Patent Document 2 has a structure in which the mounting member is inserted into the stopper that is cut out (perforating) in the first closure, and the mounting member is mounted to the first closure by means of a threaded ring or the like and, in any of these cases, the inner bag or the packaging bag is stored and transported in a state of being supported and suspended by the inlet/outlet port or the mounting member. As a result, the weight of the fluid contents is loaded on the outer circumference of the flange portion or the bottom mounting ring, both of which have been heat-sealed, and this leads to a problem in that the inner bag or the packaging bag is likely to break from this portion, and a solution to this problem has been awaited. Particularly, since the inlet/outlet port (or the mounting member) 502 is usually attached to a portion which is closer to one short side of the bag and which is substantially centered along the one short side, the weight of the fluid content is intensively loaded on the flange portion 504 or the periphery of the bottom mounting ring, both of which have been heat-sealed, on the other short side, and this causes inconvenience that this portion (indicated by reference symbol P in FIG. 7) is likely to break due to a pin hole or edge breakage.

It is an object of the present invention to provide a fluid container, in which a spout-equipped packaging bag is accommodated in an external container and the packaging bag is less likely to break due to pin holes and breakage of an edge, even if a weight of a fluid content such as resist liquid filled in the packaging bag is loaded during storage and transportation. Furthermore, it is another object of the present invention to provide a fluid container, in which impurities such as impure particles (also, referred to as particles) and metal ions are less likely to leach into the fluid content, the cleanliness (a degree that particles and the like are less likely to leach from the resin composition forming the bag into the chemical solution to contaminate the chemical solution) is high, attaching and removing the spout-equipped packaging bag to and from the external container is easy, and working efficiency and hygiene are superior.

Means for Solving the Problems

The inventors have completed the present invention by forming a heat seal portion at an outer perimeter of at least two films, thereby configuring the packaging bag body to be accommodated in the external container, joining a portion of the spout between the sealing surfaces of the heat seal portion at a predetermined position of the heat seal portion. The packaging bag body can be accommodated in the external body. The spout is attachable to and detachable from the opening portion of the external body. As a result, the bag is less likely to break even if a weight of the fluid content is loaded during the storage and transportation. Moreover, the impurities such as particles and metal ions are less likely to leach into the fluid content, thereby making it possible to maintain a high degree of cleanliness. Furthermore, the fluid container can be reused simply by taking out the used packaging bag from the external container and by setting a new packaging bag into the external container.

More specifically, the present invention provides the following.

According to a first aspect, a fluid container includes: an external container having an opening portion; and a spout-equipped packaging bag which is used as an inner bag of the external container, and made by joining a spout to a packaging bag body, in which the packaging bag body can be accommodated into the external container, and the spout is attachable to and detachable from the opening portion of the external container, and the packaging bag body is made by forming a heat seal portion in an outer perimeter of at least two films to be a bag, and a portion of the spout is joined between sealing surfaces of the heat seal portion at a predetermined position of the heat seal portion.

In the fluid container according to the first aspect of the present invention, a heat seal portion is formed at an outer perimeter of at least two films, thereby configuring the packaging bag body. A portion of the spout is joined between the sealing surfaces of the heat seal portion at a predetermined position of the heat seal portion. The spout-equipped packaging bag body is used as an inner bag to be accommodated in the external body. As a result, the bag is less likely to break due to pin holes and breakage of an edge, even if a weight of the fluid content such as resist liquid filled in the packaging bag is loaded during the storage and transportation. Moreover, leaching of impurities such as impure fine particles and metal ions into the fluid content filled inside is low, thereby making the degree of cleanliness superior.

Furthermore, the spout of the spout-equipped packaging bag can be attached and detached to and from the opening portion of the external container, and the spout is joined at the heat seal portion, instead of at the central position of the bag. This makes it easy to handle the spout-equipped packaging bag, and to attach to and detach from the external container, thereby achieving an effect of superior working efficiency and hygiene.

According to a second aspect, in the fluid container as described in first aspect, the spout is engaged with the opening portion of the external container so as to make it possible to support the packaging bag body.

According to the second aspect, the spout is engaged with an opening portion of the external container so as to be able to support the packaging bag body. This makes it possible to easily exchange the spout-equipped packaging bag, and to reuse the fluid container simply by taking out the used packaging bag from the external container and by setting a new packaging bag into the external container.

According to a third aspect, in the fluid container as described in the first or second aspect, the spout is made of synthetic resin that can be thermally-bonded on the sealing surface.

According to the third aspect, the spout is made of synthetic resin that can be thermally-bonded on the sealing surfaces of the packaging bag body. Accordingly, when the packaging bag body is heat-sealed to form a bag, the spout is heat-sealed to the packaging bag body at the same time, thereby making it possible to form the spout-equipped packaging bag more efficiently than the case of bonding with adhesive or the like. Moreover, the thermal bonding integrates the spout and the film of the packaging bag body, as a result of which the sealing properties and adhesive properties are superior.

According to a fourth aspect, in the fluid container as described in any one of the first to third aspects, a portion of the spout includes a spout-attaching portion flatly bondable to the sealing surface.

According to a fifth aspect, in the fluid container as described in the fourth aspect, the flatly bondable spout-attaching portion has a cross-section of a convex-lens shaped cylinder as a whole, and the lateral face of the cylinder is a bonded surface.

According to a sixth aspect, the fluid container as described in the fifth aspect, having tabular rib portions formed at both ends of the convex-lens shaped cylinder before sealing, is obtained by performing bonding to include the rib portions.

According to the fourth to sixth aspects, the spout-attaching portion is heat-sealed to the film of the packaging bag body at the sealing surfaces of the packaging bag body, thereby heat-bonding to the packaging bag body. Since the spout engaging portion is shaped like a convex lens, an area to be sealed with the inner layer film is large, and the heat-sealing is made possible without creating a gap at the time of heat-sealing. Furthermore, since the tabular ribs are provided at both ends and further gaps are not generated due to the tabular ribs being melted at the time of heat-sealing, the sealing properties between the spout and the packaging bag body is superior.

According to a seventh aspect, in the fluid container as described in any one of the first to sixth aspects, the external container is a rigid container that can be repeatedly used.

According to an eighth aspect in the fluid container as described in the seventh aspect, the rigid container is a metal container or a synthetic resin container.

It is preferable that the external container be constructed with a strong material in order to make it possible to be used repeatedly. A rigid container made of, for example, a material such as metal, synthetic resin and paper including corrugated cardboard is exemplified as this kind of external container; however, there is no particular limitation thereto. As for the external container, external threads are formed on the opening portion (also referred to as a bunghole), and a pair of molded handles may be provided thereto to facilitate transport. Such an aspect achieves a fluid container which is easy to operate, and is suitable for repeated use for an extended period.

According to a ninth aspect, in the fluid container as described in the seventh or eight aspect, the external container enables the opening portion to be sealed, and has a cover portion that fixes the spout.

According to the ninth aspect, the liquid that is filled in the packaging bag is less likely to leak during storage and transport.

According to a tenth aspect, in the fluid container as described in any one of the first to ninth aspects, the packaging bag body is configured with a multilayered film that is made by at least stacking an outer layer film and an inner layer film in such a way that the inner layer films face each other, and a heat seal portion is formed at an outer periphery.

According to the tenth aspect, one face of the packaging bag body is configured with a multilayered film made by at least stacking the inner layer film and the outer layer film. Accordingly, for example, a film, for which leaching impure particles is extremely difficult, is used as the inner layer film, and a film such as a stretched film that has a superior strength is used as the outer layer film, thereby making it possible to achieve a superior mechanical strength and superior level of cleanliness, and greatly reducing the leaching of impure particles into the content such as a resist liquid filled in the packaging bag. Naturally, the multilayered film makes it possible to improve the strength such as puncture resistance.

The inner layer film and the outer layer film may be either a single-layered configuration or a multilayered configuration, but the multilayered configuration is preferable because particularly the outer layer film requires a property that is superior in mechanical tenacity, flex resistance, puncture resistance, impact resistance, cold resistance, heat resistance and chemical resistance, as well as heat-sealing properties.

According to an eleventh aspect, the fluid container as described in any one of the first to tenth aspects is used to accommodate a resist liquid.

According to a twelfth aspect, in the fluid container as described in the eleventh aspect, a capacity for accommodating the resist liquid is in a range of 1 L to 250 L.

According to the eleventh aspect, the spout-equipped packaging bag of the present invention is superior in strength, and can be attached and detached to and from the external container easily. Moreover, the chemical resistance properties against solvents and the like are high. This makes it particularly suitable for storing resist liquid. In this case, although the capacity for accommodating the resist liquid is, for example, in a range of 1 L to 250 L, since the packaging bag of the present invention is superior in strength, particularly in the sealing strength between the spout and the packaging bag body, it is particularly preferably used for accommodating heavy content as in the state of the twelfth aspect.

According to a thirteenth aspect, a fluid-containing container, in which the spout-equipped packaging bag is mounted in the external container constituting the fluid container as described in any one of the first to twelfth aspects, fluid is accommodated in the packaging bag, the spout is sealed, and the spout is fixed to the opening portion.

According to a fourteenth aspect, in the fluid-containing container as described in the thirteenth aspect, a cover, which seals and covers the opening portion, directly or indirectly seals the spout, and directly or indirectly fixes the spout to the opening portion.

The invention of the thirteenth and fourteenth aspects is developed as a fluid-containing container that uses the fluid container of the first to twelfth aspects. According to this invention, the effects of the first to twelfth aspects can be obtained as the fluid-containing container. In summary, the packaging bag is less likely to break due to pin holes and breakage of an edge, even if a weight of the fluid content such as resist liquid filled is loaded in the packaging bag during the storage and transportation. In addition, there is little leaching of impurities such as impure fine particles and metal ions into the fluid content, thereby achieving a high level of cleanliness. Furthermore, since it is easy to attach and detach the spout-equipped packaging bag to and from the external container, working efficiency and hygiene are superior. Moreover, according to the present invention, it is easy to perform injection and drainage of liquid by use of a joining bracket to be described later. It should be noted that, in the present invention, the term "directly or indirectly" includes not only cases where the spout is directly sealed by a cover, or substantially directly sealed and fixed by way of an O-ring or the like, but also cases where the spout is indirectly sealed and fixed by way of other elements such as a bracket 30, a first cover 50 or the like.

Effects of the Invention

In the fluid container according to the present invention, which is configured as described in any one of the first to fifteenth aspects above, the packaging bag is less likely to break due to pin holes and breakage of an edge, even if a weight of the fluid content such as resist liquid filled in the packaging bag is loaded during the storage and transportation. Moreover, in cases where the accommodated spout-equipped packaging bag has the multilayered film configuration, in which at least two films are stacked on one face, superior effects are achieved such that the packaging bag body is superior in mechanical strength such as tenacity, flex resistance, puncture resistance and impact resistance, and there is little leaching of impurities such as particles and metal ions into the filled content, thereby making it possible to maintain a high degree of cleanliness. In addition, since it is easy to attach and detach the spout-equipped packaging bag to and from the external container, working efficiency and hygiene are superior. Furthermore, there is no fear that the filled liquid may leak during the storage and transportation and, liquid can be easily injected and drained by means of the joint attached to the joining bracket to be described later, or by way of the liquid pouring tube to be described later as well.

PREFERRED MODE FOR CARRYING OUT THE INVENTION

In the following, embodiments of the present invention are described with reference to the drawings.

Overall Configuration

Figure 1:
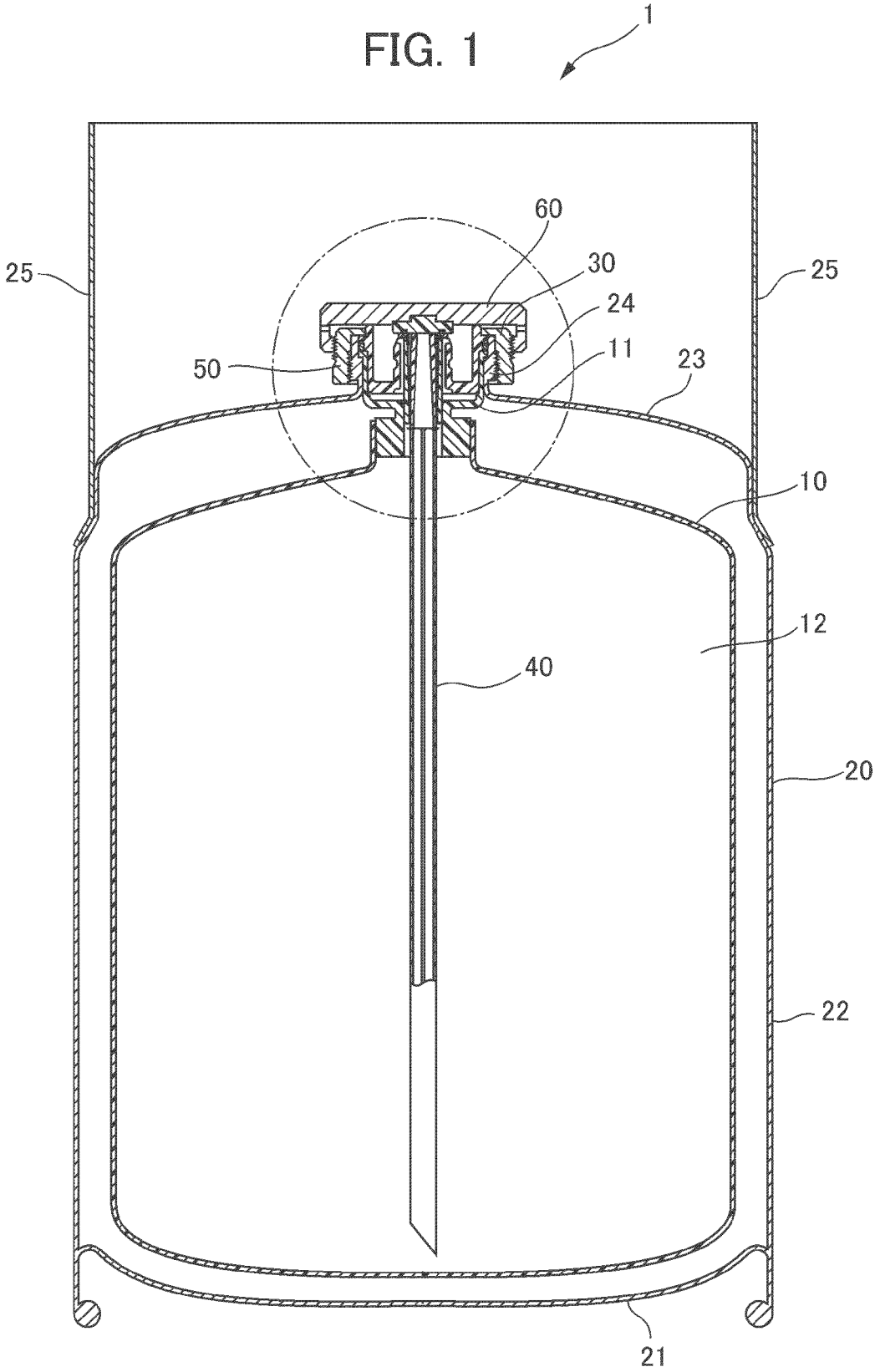
FIG. 1 is a longitudinal section showing an embodiment of a fluid container according to the present invention.
Figure 2:
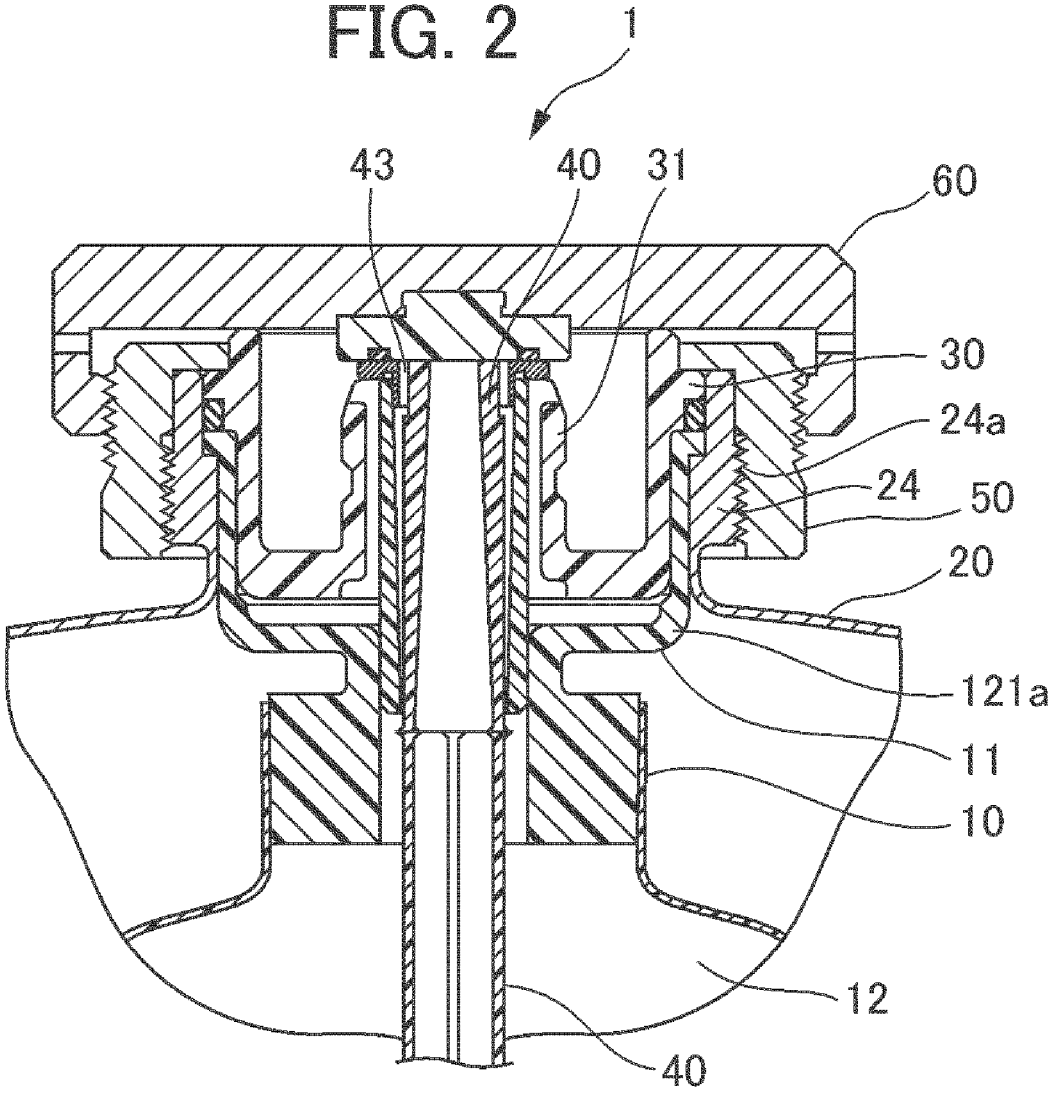
FIG. 2 is a cross-sectional enlarged view showing an enlarged opening portion of the fluid container according to the embodiment.
Figure 3:
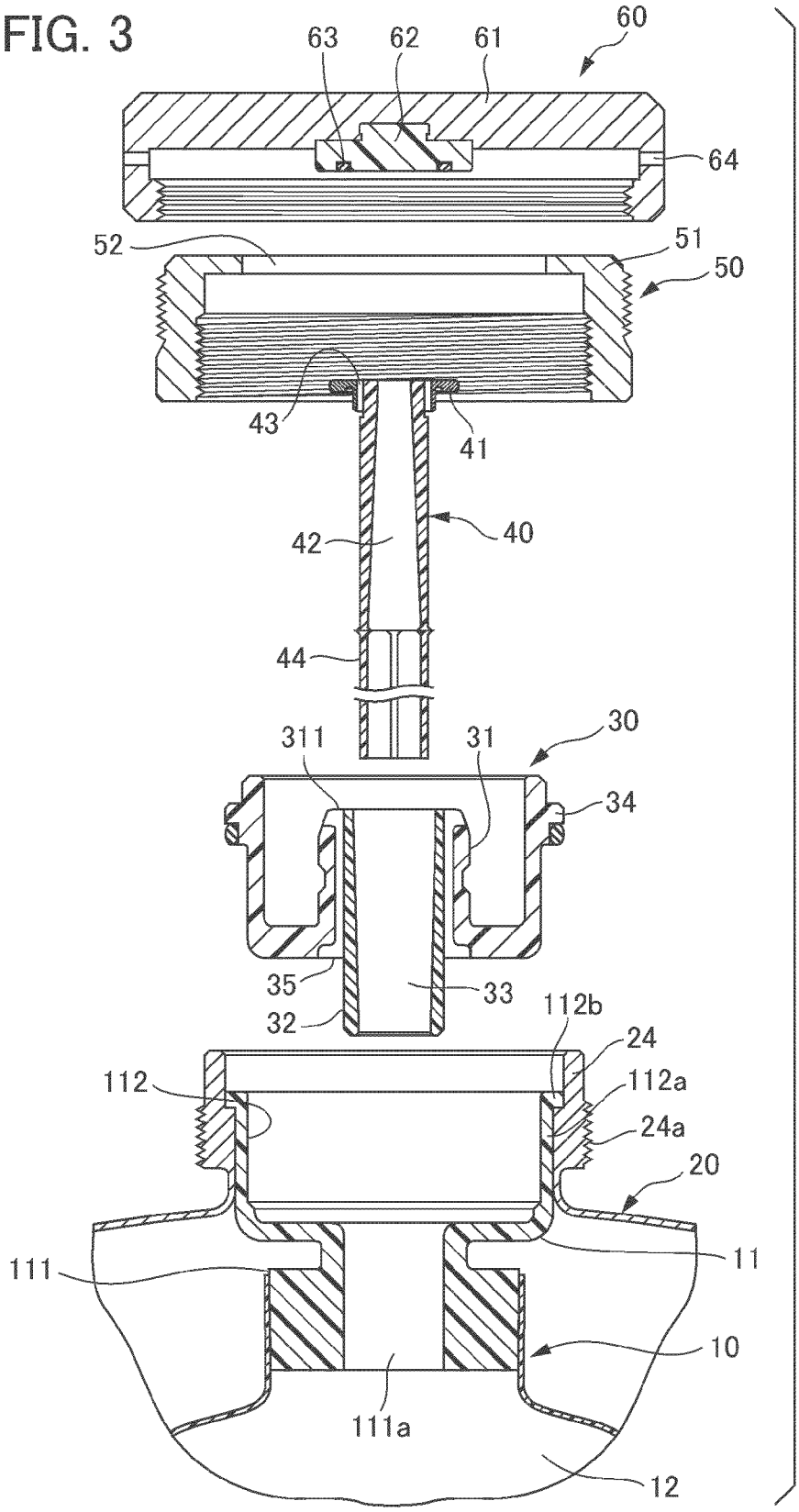
FIG. 3 is a cross-sectional exploded view of the opening portion of the fluid container according to the embodiment.
Figure 4:
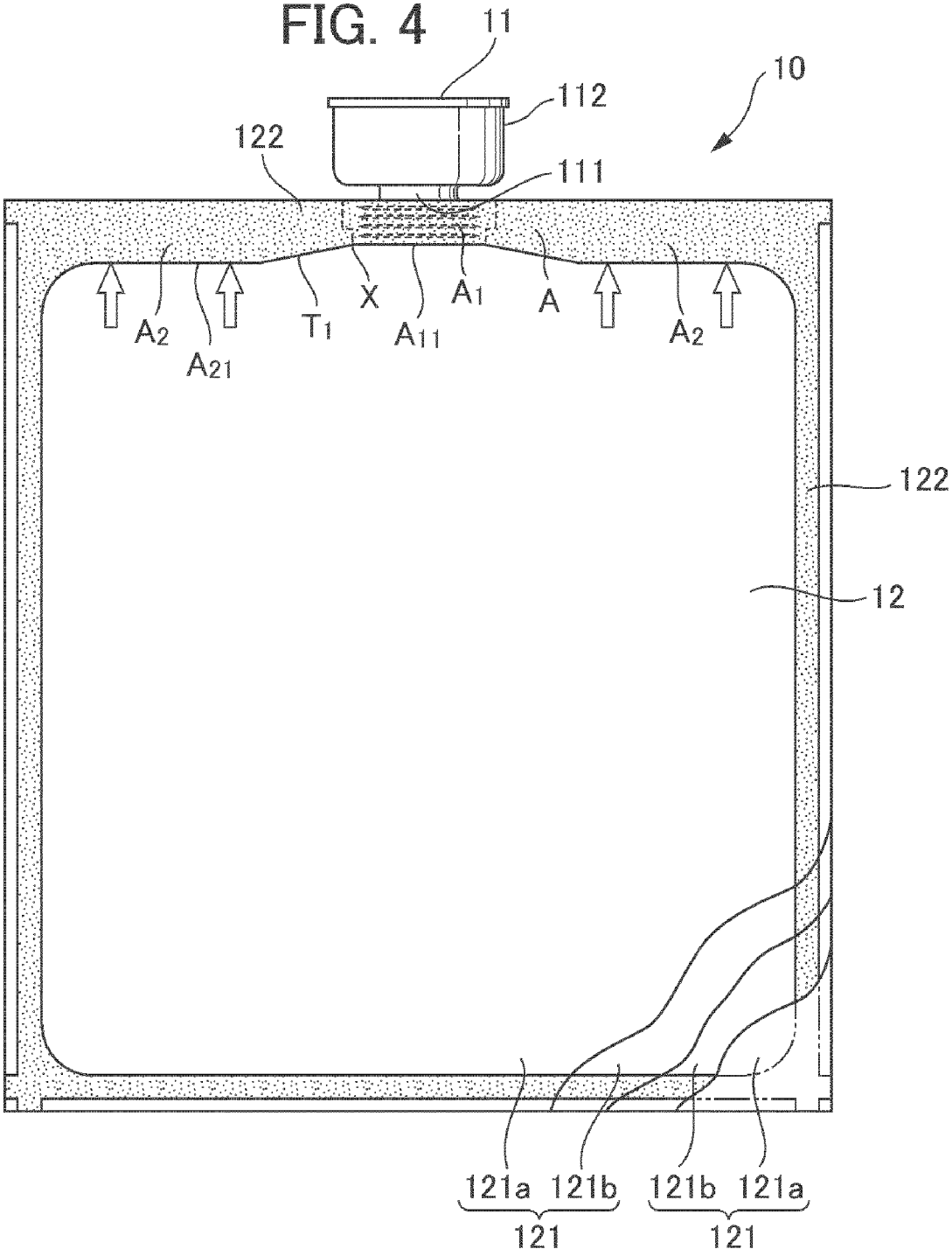
FIG. 4 is a plan view showing one embodiment of a spout-equipped packaging bag accommodated in an external container of the fluid container according to the embodiment.
Figure 5A:
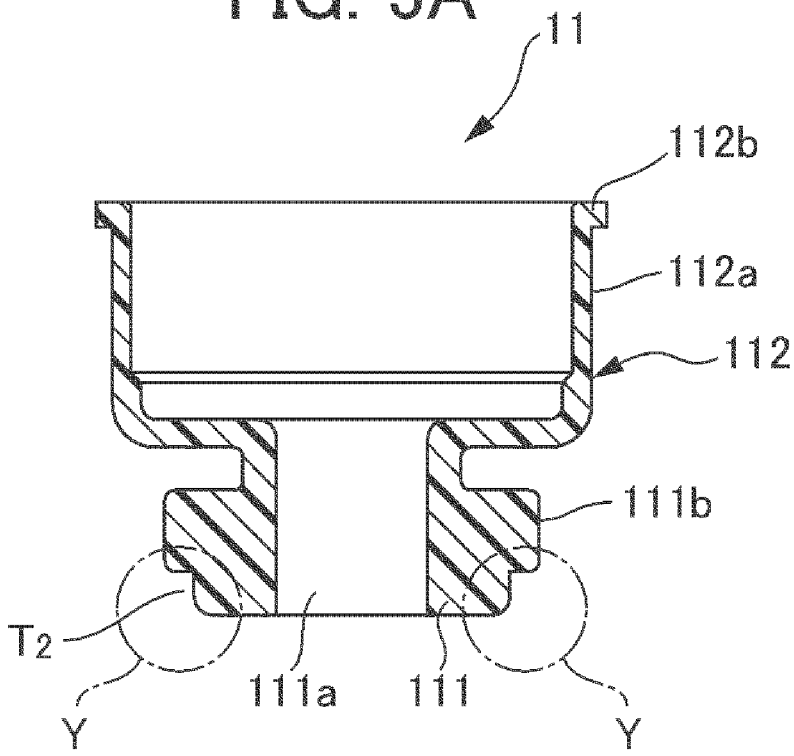
FIG. 5A is a longitudinal section showing the spout of the spout-equipped packaging bag accommodated in the external container of the fluid container according to the embodiment.
Figure 5B:
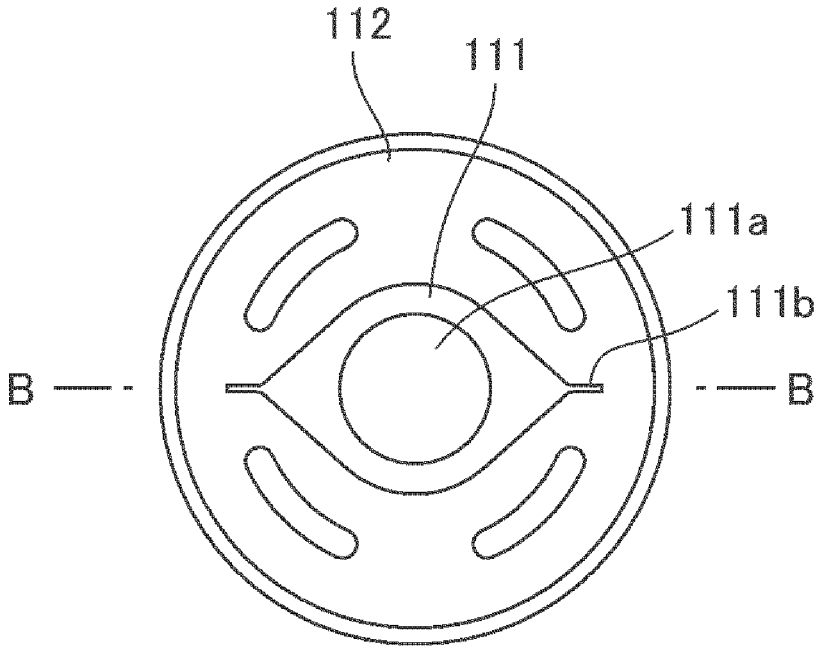
FIG. 5B is a bottom plan view observed from the spout-mounting side, showing the spout of the spout-equipped packaging bag accommodated in the external container of the fluid container according to the embodiment.

FIG. 1 is a longitudinal section showing an embodiment of a fluid container according to the present invention; FIG. 2 is a cross-sectional enlarged view showing an enlarged opening portion of the fluid container according to the embodiment; FIG. 3 is a cross-sectional exploded view of the opening portion of the fluid container according to the embodiment; FIG. 4 is a plan view showing one embodiment of a spout-equipped packaging bag accommodated in an external container of the fluid container according to the embodiment; and FIG. 5 is a diagram showing the spout of the spout-equipped packaging bag accommodated in the external container of the fluid container according to the embodiment, where (a) is a longitudinal section (section B-B of FIG. 5 (*b*)), and (b) is a bottom plan view observed from the spout-mounting side.

First, a configuration of a fluid container according to the present invention is explained. As shown in FIGS. 1 to 3, a fluid container 1 includes: a flexible spout-equipped packaging bag 10; an external container 20 having an opening portion 24; a cylindrical joining bracket 30 held by the opening portion 24; a liquid pouring tube 40 inserted into a cylindrical portion 32 of the joining bracket 30; a circular first cover 50 which engages by way of threading with the opening portion 24 and which holds a spout 11 and the joining bracket 30 to the opening portion 24; and a second cover 60 having a bushing 62 that protrudes inward. The spout-equipped packaging bag 10 has the spout 11 that opens to enable liquid to be injected, and a packaging bag body 12 for filling fluid content. The external container 20 can support the spout 11 with the opening portion 24, and accommodate the spout-equipped packaging bag 10. The spout-equipped packaging bag 10 is washed in advance, and is accommodated into the external container 20. After draining liquid from the spout-equipped packaging bag 10, the spout-equipped packaging bag 10 is discarded, and a new spout-equipped packaging bag 10 is accommodated in the external container 20. The fluid container according to the present invention is a dual storage system-type container, in which the outer container is repeatedly used, and a new spout-equipped packaging bag is used each time.

Spout-Equipped Packaging Bag

As shown in FIG. 4, the spout-equipped packaging bag 10 includes the packaging bag body 12 and the spout 11. The packaging bag body 12 is made by forming a heat sealed portion 122 by heat-sealing the four sides of a multilayered film 121 in a way that inner layer films 121*b* face each other, the multilayered film 121 being made by at least overlapping an outer layer film 121*a* and an inner layer film 121*b*. The injection-molded spout 11 is heat-sealed in advance between the inner layer films 121*b* of the heat sealed portion 122 at one side (the top side in FIG. 4) of the packaging bag body 12.

It should be noted that the packaging bag body 12 may be formed by folding the multilayered film 121 in a way that the inner layer films 121*b* face each other, thereby forming the overlapping three outer periphery sides as the heat sealed portion 122. In addition, the inner corners of the heat sealed portion 122 may by formed as arc-shaped corners. As a result of this structure, the fluid content is less likely to remain in the corners.

Spout

The spout 11 includes a spout attaching portion 111 and a spout engaging portion 112 connected to one side of the spout attaching portion 111, and is heat-sealed between the inner layer films 121*b* of the multilayered film 121 at the spout attaching portion 111 as shown in FIG. 4. Tapers (or steps) $T_1$ are formed in the heat sealed portion 122 including the spout attaching portion 111, so that the seal width of the right and left seal portions $A_2$ excluding the seal portion $A_1$ is generally wider than the seal width of the seal portion $A_1$ of the spout attaching portion 111. The tapers $T_1$ make it possible to receive the internal pressure of the bag loaded in the direction of arrows in FIG. 4 with the seal sides $A_{21}$ of the seal portions $A_2$. This reduces the pressure loaded on the spout attaching portion 111, particularly the pressure loaded on the vicinities of both ends X of the seal side $A_{11}$, thereby making it possible to prevent breakage of an edge and the like due to the repeated vibration caused during transportation.

As shown in FIGS. 5 (*a*) and (*b*), the spout attaching portion 111 of the spout 11 is a cylinder with a cross-sectional shape of a convex lens, which has a first through hole 111*a* in a central portion thereof, and includes a pair of tabular ribs 111*b* at both ends. A gap is likely to arise in two regions surrounded by the inner layer films 121*b* and the end of the spout attaching portion 111 when the spout 11 is heat-sealed with the spout attaching portion 111 between the inner layer films 121*b* of the multilayered film 121, leading to failure in sealing. In order to prevent this, the tabular ribs 111*b* are provided at both ends and melted at the time of the heat-sealing, as a result of which no gap arises.

It should be noted that, in this embodiment, as shown in FIG. 5 (*a*), a stepped portion $T_2$ is provided in corner Y of a lower side of the tabular rib 111*b*, the width of the stepped portion $T_2$ being smaller than the width of the spout attaching portion 111 in the height direction. This stepped portion $T_2$ is made in consideration for preventing the corner Y from being an acute angle even if a resin puddle such as PE (polyethylene) arises in the corner Y after adhering of the spout 11. This makes it possible to prevent breakage of an edge of the corner Y due to repeated vibration and the like during transportation, as in the case of the above.

As shown in FIG. 5 (*a*), a spout engaging portion 112 is provided with a cylindrical portion 112*a* of which a cross section is substantially U-shaped, and a flange 112*b* around an upper end periphery thereof. A plurality of openings may be formed at the bottom of the cylindrical portion 112*a*. This makes it possible to ensure ventilation between the spout-equipped packaging bag 10 and the external container 20. That is to say, when fluid is poured out at the time of use, by enclosing gas between the spout-equipped packaging bag 10 and the external container 20, thereby putting a pressure from outside the packaging bag body 12, it is possible to smoothly perform pouring out of the fluid from the inside thereof.

Figure 6A:
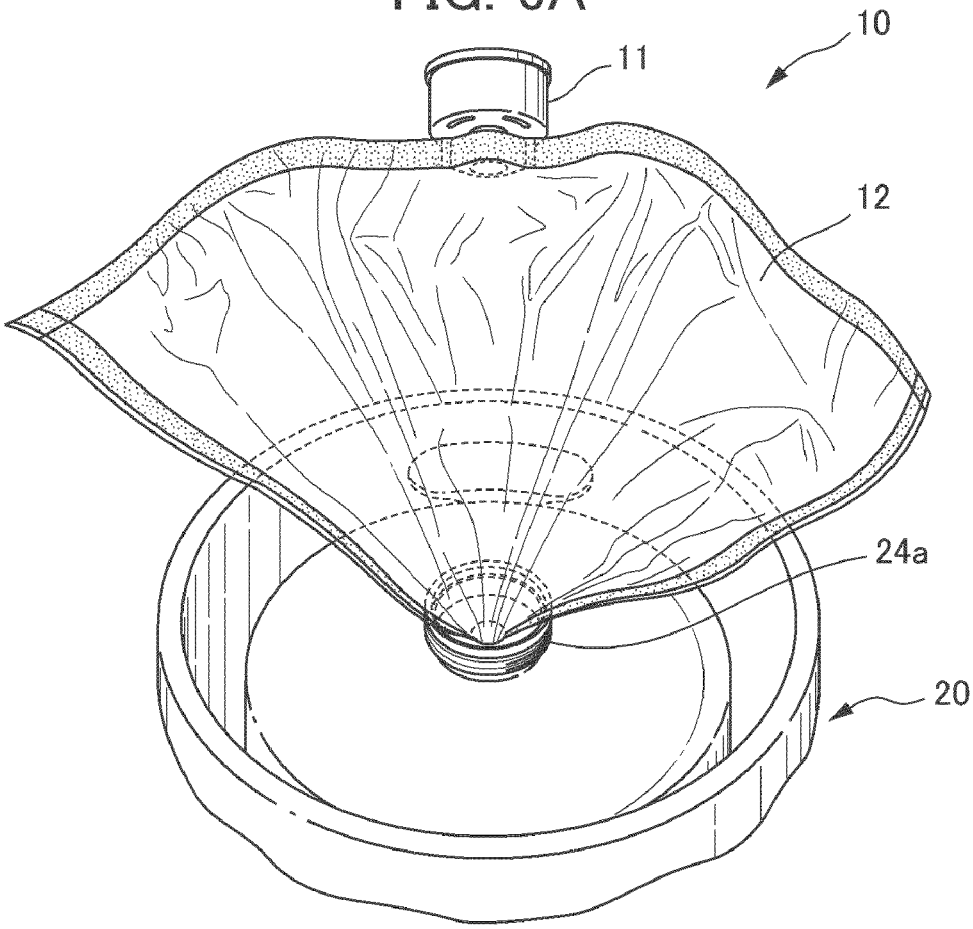
FIG. 6A is a partial perspective view showing a state of inserting the spout-equipped packaging bag into the external container according to the embodiment.
Figure 6B:
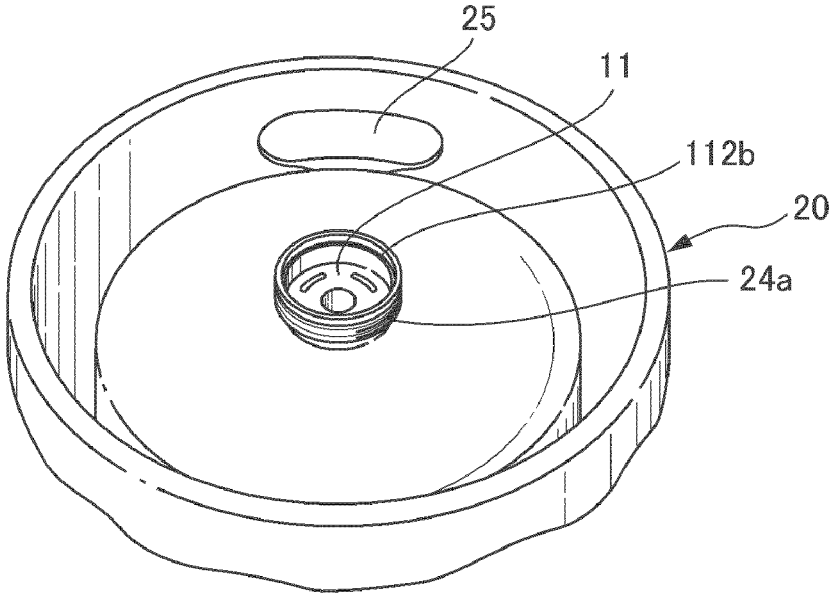
FIG. 6B is a partial perspective view showing a state after the spout-equipped packaging bag is accommodated into the external container according to the embodiment.
Figure 7:
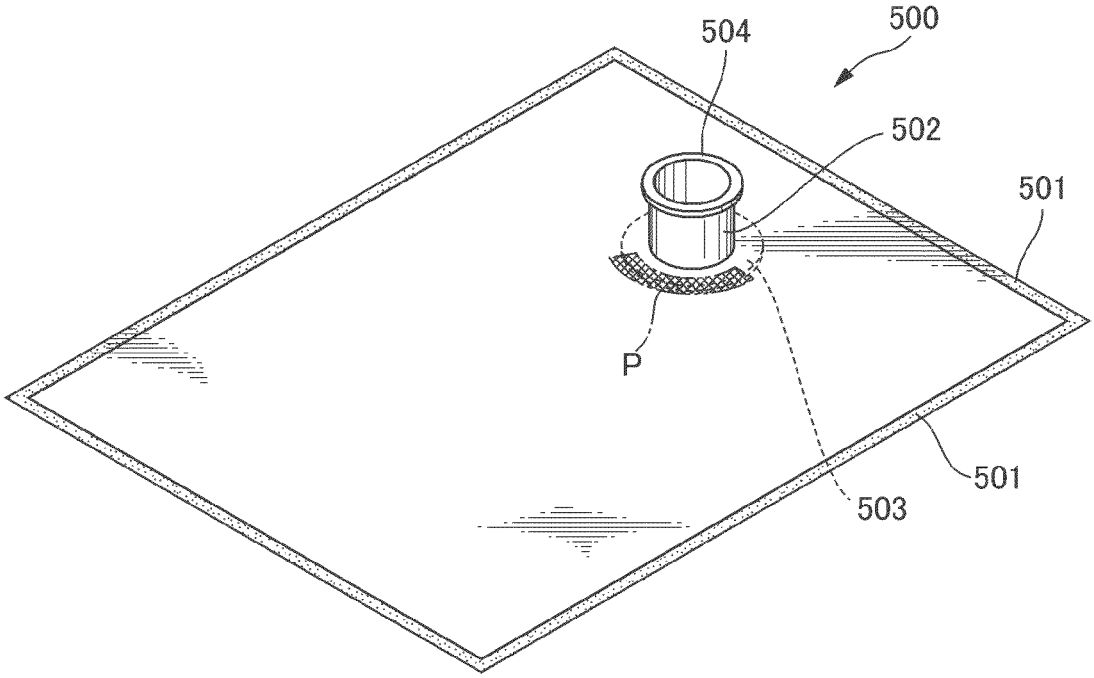
FIG. 7 is a perspective view showing one embodiment of a conventional spout-equipped packaging bag.

The flange 112*b* abuts and engages with the upper periphery of the substantially cylindrical opening portion 24 at the position that is shorter than the dimension in the height direction of the spout engaging portion 112 that is formed at the external container 20 accommodating the spout engaging portion 112 of the spout 11, thereby achieving a structure in which the spout-equipped packaging bag 10 is supported within the external container 20 (refer to FIG. 6).

The spout 11 is preferably manufactured by an injection molding process. Resin to be used for this is not particularly limited as long as the resin can be injection-molded. Since the spout-equipped packaging bag 10 is manufactured by thermobonding with the resin constituting the inner face of the inner layer film 121*b* of the multilayered film 121, it is necessary to appropriately select a resin constituting the inner face of the inner layer film 121*b*, and high density polyethylene is preferable for this resin, because it is usually rigid at higher temperatures and difficult to embrittle at lower temperatures.

Moreover, in addition to the high density polyethylene, as the material for the spout 11 or the inner layer film 121*b*, a fluorinated resin such as tetrafluoroethylene-perfluoroalkylvinyl ether copolymer (hereinafter abbreviated as PFA) or polytetrafluoroethylene (hereinafter abbreviated as PTFE) may be used, which is superior in, for example, heat resistance, resistance to chemicals, non-adhesiveness and low-temperature properties. In this case, it is preferable that a PTFE film be used for the multilayered film 121 constituting the packaging bag body 12.

Packaging Bag Body

In this embodiment, the multilayered film 121 is constituted at least by the outer layer film 121*a* and the inner layer film 121*b*.

Outer Layer Film

The outer layer film 121*a* may be either of a single-layered configuration or a multilayered configuration, but the multilayered configuration is preferable in terms of material selection and cost, because the outer layer film 121*a* requires a property that is superior in mechanical tenacity, flex resistance, puncture resistance, impact resistance, cold resistance, heat resistance and chemical resistance, as well as heat-sealing properties for the inner layer film 121*b*.

It should be noted that the single-layered configuration may be employed in cases where mechanical strength is not required so much because the internal volume of the spout-equipped packaging bag 10 is small and the weight of the contents to be filled therein is light and the like.

The multilayered configuration consists of a base layer and a thermobonding resin layer. As the base layer, a film can be used, which consists of a resin such as polyester based, polyamide based, polypropylene based, polyethylene based and the polyacetal based. A stretched film that is stretched in a single axial direction or two axial directions is suitable for the base layer. However, the spout-equipped packaging bag 10 is accommodated in the external container 20 for transportation and storage, and the fluid content is severely shaken in the bag during the transportation in particular. Accordingly, it is necessary to prevent pin holes and cracks caused by the shaking, and therefore a biaxial stretching polyamide film is preferable for this. The film thickness may be determined by taking into consideration the cost and the like, as long as the thickness can minimally maintain strength, rigidity and the like as a base material.

Moreover, resin for a thermobonding resin layer may include, for example, at least one kind of low density polyethylene, intermediate density polyethylene, high density polyethylene, linear low density polyethylene, polypropylene, ethylene alpha olefin copolymer, ethylene-propylene copolymer, ethylene-vinyl acetate copolymer, ionomer resin, ethylene-acrylic acid copolymer, ethylene-methyl acrylate copolymer and ethylene-methacrylic acid copolymer, which can be appropriately selected and used depending on the type of the fluid content. However, generally, polyethylene is preferable because it is superior in low-temperature sealability. Furthermore, linear low density polyethylene is preferable because the molecular weight distribution thereof is narrow, it is superior in heat sealing strength, which is polymerized by use of metallocene catalyst which has little effect on the fluid content.

Moreover, an intermediate layer may be provided between the base layer and the thermobonding resin layer as necessary in order to give gas barrier properties such as for oxygen or water vapor to the outer layer film 121*a*. Materials constituting this intermediate layer may include, for example: a metallic foil such as aluminum, iron, copper and tin; a film such as polyvinyl alcohol, ethylene-vinyl alcohol copolymer and polyvinylidene chloride; a film onto which polyvinylidene chloride has been applied, the film being made of polyolefin such as polyester, polyamide, polyethylene, polypropylene and ethylene-propylene copolymer, and vinyl alcohol; and a film onto which an inorganic deposition layer has been applied such as aluminum, silicon oxide, aluminum oxide, indium oxide, tin oxide and zirconium oxide.

In addition, this intermediate layer gives not only the aforementioned gas barrier properties, but also imparts features such as mechanical tenacity, flex resistance, puncture resistance, impact resistance, cold resistance, heat resistance and chemical resistance. The material that imparts the aforementioned gas barrier properties may be used in combination with a film of polyolefin such as of polyester, polyamide, polyethylene, polypropylene and the ethylene-propylene copolymer.

Moreover, as a base layer, the aforementioned film onto which polyvinylidene chloride has been applied, or the aforementioned film, onto which an inorganic deposition layer such as silicon oxide, aluminum oxide, indium oxide, tin oxide and zirconium oxide has been formed, may be used.

Moreover, as a method of laminating each layer of the outer layer film 121*a*, an anchor coating agent such as organic titanate, polyethyleneimine derivative, silane coupling agent and isocyanate based compound is applied onto one face of the base layer, and it is dried. Subsequently, the thermobonding resin layer may be heated, melted and extruded by a T-die extruder to laminate, or the thermobonding resin layer may be prepared in a film state to laminate by way of a sandwich lamination process, or a two-component curing polyurethane adhesive consisting of polyol component and isocyanate component is used to laminate by way of a well-known dry lamination process. Moreover, as a matter of course, an easy adhesive treatment such as a corona discharge treatment, an ozone treatment and a plasma treatment may be performed on a necessary face of each layer depending on the requirement.

Inner Layer Film

On the other hand, the inner layer film 121*b* may have a single-layered configuration, and alternatively, the inner layer film 121*b* may have a multilayer configuration in a sense that pin holes and cracks are prevented in collaboration with the outer layer film 121*a*, or in a sense that tensile strength or heat sealing strength or the like of the spout-equipped packaging bag 10 itself consisting of the multilayered film 121 is improved.

In the case of the single-layered configuration, the resin of the inner layer film needs to be a resin which is capable of thermobonding with the thermobonding resin layer of the outer layer film 121*a*, and may be appropriately selected depending on the type of the resin to be used for the thermobonding resin layer; however, for the same reason as described for the thermobonding resin layer of the outer layer film 121*a*, polyethylene or linear low density polyethylene that is polymerized by use of metallocene catalysts is preferable.

As described above, high density polyethylene, which is usually rigid even at high temperature and is difficult to embrittle at low temperature, is preferable for the spout 11. For such reasons, as the thermobonding resin layer constituting the inner face of the inner layer film 121*b*, polyethylene or a linear low density polyethylene that is polymerized by use of metallocene catalysts is preferable.

As a linear low density polyethylene that is polymerized using metallocene catalyst, namely ethylene-alpha olefin copolymer that is polymerized using metallocene catalyst, for example, a catalyst made by combining metallocene complex and almoxan such as a catalyst made by combining dichloride zirconocene and methylalmoxan, namely ethylene-alpha olefin copolymer that is made by copolymerization of ethylene and alpha-olefin by using metallocene catalyst can be used. The metallocene catalyst is also referred to as a single site catalyst because the active sites thereof are uniform, while the current catalyst is referred to as a multisite catalyst because the active sites thereof are nonuniform (metallocene catalysts hereinafter indicates a single site catalyst). More specifically, as the ethylene-alpha olefin copolymer that is polymerized using metallocene catalyst, it is possible to use ethylene-alpha olefin copolymer that is polymerized using metallocene catalyst, such as "KERNEL" (trade name) manufactured by Mitsubishi Chemical Corporation, "EVOLUE" (trade name) manufactured by Mitsui Petrochemical Industries, Ltd., "EXACT" (trade name) manufactured by Exxon Chemical Corporation in the USA, "AFFINITY" (trade name) and "ENGAGE" (trade name) manufactured by Dow Chemical Company in the USA.

The aforementioned ethylene-alpha olefin copolymer that is polymerized using metallocene catalyst is described in more detail. More specifically, it is possible to use ethylene-alpha olefin copolymer made by copolymerization with ethylene-alpha olefin by using for example, a catalyst made by combining a metallocene based transition metal compound and organoaluminum compound, namely metallocene catalyst (including a so-called Kaminsky catalyst). It should be noted that the aforementioned metallocene catalyst is used while supported on an inorganic substance in some cases. In the above, as the metallocene-based transition metal compound, it is possible to use, for example, transition metals chosen from IVB family, in which, more specifically, one or two of a cyclopentadienyl group, substituted cyclopentadienyl group, indenyl group, substituted indenyl group, tetrahydro indenyl group, substituted tetrahydro indenyl group, fluorenyl group or substituted fluorenyl group is coupled to titanium (Ti), zirconium (Zr) or hafnium (Hf), or in which two groups among these are crosslinked by a covalent bond; and in addition, it is possible to use a substituent including a hydrogen atom, oxygen atom, halogen atom, alkyl group, alkoxy group, aryl group, acetylacetonato group, carbonyl group, nitrogen molecule, oxygen molecule, Lewis base and silicon atom, and one having a ligand such as unsaturated hydrocarbon. Moreover, in the above, alkylaluminum or chain- or cyclic-aluminoxane can be used as the organoaluminum compound. In this case, as alkylaluminum, it is possible to use, for example, triethylaluminium, triisobutylaluminium, dimethylaluminum chloride, diethylaluminium chloride, methyl aluminum dichloride, ethylaluminum dichloride, dimethylaluminum fluoride, diisobutylaluminum hydride, diethylaluminum hydride, ethylaluminium sesquichloride and the like. Moreover, the chain- or cyclic-aluminoxane can be generated, for example, by causing alkylaluminum to contact with water. The chain- or cyclic-aluminoxane can be generated, for example, by adding alkylaluminum at the time of polymerization, and adding water thereafter, or by causing crystallization water of a complex salt or absorbed water of organic/inorganic compound to react with alkylaluminum. Moreover, in the above, as an inorganic substance for supporting the metallocene catalyst, it is possible to use silica gel, zeolite and diatomite.

Moreover, in the above, as the polymerization method, various polymerization methods can be performed such as block polymerization, solution polymerization, suspension polymerization and vapor phase polymerization. Moreover, the polymerization may be either a batch process or a continuous process. In the above, as polymerization conditions, the polymerization temperature is in a range of −100 to 250 degrees Celsius, the polymerization time is in a range of 5 minutes to 10 hours, and the reaction pressure is approximately in a range of the normal pressure to 300 kg/cm$^2$. Furthermore, in the present invention, as an alpha olefin that is a comonomer which is copolymerized with ethylene, it is possible to use, for example, propylene, 1-butene, 3-methyl-1-butene, 4-methyl-1-pentene, 1-hexene, 1-octene, decene and the like. The aforementioned alpha olefin may be used alone or in combination of two or more. In addition, as the mixing percentage of the aforementioned alpha olefin, a range of 1 mass % to 50 weight % is preferable, and a range of 10 mass % to 30 weight % is more preferable. In the present invention, as the physical properties of the ethylene-alpha olefin copolymer that is polymerized using the metallocene catalyst, for example, the molecular weight is in a range of $5\times10^3$ to $5\times10^6$, the density is in a range of 0.890 g/cm$^3$ to 0.930 g/cm$^3$, and the melt flow rate (MFR) is approximately in a range of 0.1 g/10 minutes to 50 g/10 minutes. It should be noted that, in the present invention, the aforementioned ethylene-alpha olefin copolymer that is polymerized using metallocene catalyst can be used by optionally adding, for example, an antioxidant, ultraviolet absorber, antistatic agent, anti-blocking agent, lubricant (fatty amide and the like), flame retardant, inorganic filler, organic filler, dye, pigment and the like.

Moreover, the multilayered configuration consists of a core layer and thermobonding resin layers on both faces thereof. As in the case of the base layer of the outer layer film 121*a*, the core layer is preferably superior in mechanical tenacity, flex resistance, puncture resistance, impact resistance, cold resistance, heat resistance and chemical resistance, and the layer consisting a resin such as polyester based, polyamide based, polypropylene based, polyethylene based, polyacetal based and the like can be exemplified. Moreover, the layer may not be stretched, or the layer may consist of resin stretched in a single axial direction or two axial directions. As in the case of the base layer 200 of the outer layer film 121*a*, the layer consisting of polyamide is preferable, and the configuration, in which thermobonding resin layers are provided to both faces of this polyamide layer, is particularly preferable.

For the thermobonding resin layer provided on both faces of the core layer, it is presumed that one face thereof is capable of thermobonding with the thermobonding resin layer of the outer layer film 121*a*, and the other face thereof is capable of thermobonding with the spout 11 consisting of the aforementioned high density polyethylene. For the reason explained for the thermobonding resin layer of the outer layer film 121*a*, polyethylene is suitable, and linear low density polyethylene that is polymerized using metallocene catalyst is preferable.

As a laminating method for the inner layer film 121*b* in the case of the multilayered configuration, each layer may be laminated with the laminating method described for the outer layer film 121*a*; however, it is preferable to perform the lamination by use of the coextrusion method that can laminate five layers (thermobonding resin layer/adhesive layer/core layer/adhesive layer/thermobonding resin layer) all at once, in order to achieve low manufacturing cost.

It should be noted that, in cases where the thermobonding resin layer is a polyolefin that is represented by polyethylene and polypropylene, polyolefin that is graft-modified with unsaturated carboxylic acid can be preferably used as an adhesive layer, such as ADMER (trade name, manufactured by Mitsui Chemicals Inc.), MODICK (trade name, manufactured by Mitsubishi Chemical Corporation) and POLYTACK (trade name, manufactured by Idemitsu Petrochemical Co., Ltd.).

Other Configurations

In addition, though it is not illustrated, an intermediate layer film may be provided between the outer layer film 121*a* and the inner layer film 121*b*, thereby configuring the multilayered film 121 with three or more layers. The intermediate layer film is provided depending on the physical properties required for the spout-equipped packaging bag 10. For example, a film to be used may be a single layered film consisting of a resin that is similar to the resin described for the thermobonding resin layer of the outer layer film 121*a*, or may be configured in such a way that the thermobonding resin layer is on a face that expresses the base layer of the outer layer film 121*a*, or may be the configuration of layers described for the inner layer film 121*b*. In all events, the thermobonding resin layers respectively facing the outer layer film 121*a*, the intermediate layer film and the inner layer film 121*b* are preferably a combination of resins that are capable of thermobonding with each other.

It should be noted that the film configuring the packaging bag body 12 in the present invention may not necessarily be a multilayered film as long as the most inner face is capable of heat-sealing, and may have a normal configuration in which, for example, only the single pair of outer layer films 121*a* is used.

Moreover, for the spout 11 and the inner layer film 121*b*, other than the aforementioned high density polyethylene, fluorinated resin such as PFA or the PTFE may be used, which is superior in, for example, heat resistance, chemical resistance, non-adhesiveness, and low-temperature characteristics. In this case, it is preferable to use a PTFE film also for the film configuring the packaging bag body 12.

External Container

As shown in FIG. 1, a steel container is preferably used as the external container 20, which is configured with a base plate 21, a side wall 22 and a top board 23 having a center that bulges, and an opening portion 24 is formed in a substantially central portion of the top board 23. An external thread 24*a* is formed on the outer periphery of the opening portion 24. Moreover, a pair of hand portions 25 (see FIG. 6) may be provided above the top board 23 of the side wall 22, thereby facilitating transportation.

As the external container 20, a rigid container made of a material such as metal, synthetic resin and paper including corrugated cardboard is exemplified; however, there is no particular limitation thereto.

As shown in FIG. 2 or 3, a flange 112*b* is formed on an orifice side of the spout 11 of the spout-equipped packaging bag 10, while a step is provided to the inner wall of the opening portion 24 and this flange 112*b* engages with the step, thereby supporting the spout 11 to the opening portion 24. The spout-equipped packaging bag 10 is accommodated into the external container 20, the spout 11 joined to the spout-equipped packaging bag 10 is supported by the opening portion 24 of the external container 20. Subsequently, the spout-equipped packaging bag 10 is preferably expanded by nitrogen or compressed air. Thereafter, liquid is poured through the first through hole 111*a* into the spout-equipped packaging bag 10 (see FIG. 2 or 3).

Joint of Container

The container according to the present invention includes a cylindrical joining bracket 30 and a liquid pouring tube 40 (see FIG. 2 or 3). In FIG. 2, the joining bracket 30 is held by the opening 24. In addition, the joining bracket 30 has a substantially cylindrical header portion 31 in one end, and has a cylindrical portion 32 in the other end. Furthermore, the joining bracket 30 has a through hole 33 penetrating from the one end to the other end. The header portion 31 protrudes from a base of the joining bracket 30. The cylindrical portion 32 fits into the first through hole 111*a* of the spout 11 (see FIG. 3).

In FIG. 2 or 3, the liquid pouring tube 40 has, in the first end thereof, a collar portion 41 adhered to a top face 311 of the header portion 31 of the joining bracket 30. In addition, the second end of the liquid pouring tube 40 is inserted into the second through hole 33 of the joining bracket 30. The liquid pouring tube 40 has a fluid passage 42 extending from the one end to the other end, and the liquid in the spout-equipped packaging bag 10 is drained through the fluid passage 42 (see FIG. 1).

The outer diameter of the joining bracket 30 is slightly smaller than the inner diameter of the spout 11, and the joining bracket 30 fits into the spout 11 supported by the opening portion 24 (see FIG. 2). A flange 34, which has an external diameter that is slightly smaller than the inner diameter of the opening portion 24, is provided to one end of the joining bracket 30, and an O-ring is supported by this flange 34, thereby sealing the opening portion 24 (see FIG. 2 or 3).

A first cover 50 is fastened to the opening portion 24, as a result of which the joining bracket 30 is held to the opening portion 24 together with the spout 11 (see FIG. 2). A predetermined gap is provided between the bottom external wall of the joining bracket 30 and the bottom inner wall of the cylindrical portion 112*a* of the spout 11 (see FIG. 2).

In FIG. 3, the cylindrical portion 32 is provided to protrude from the bottom of the joining bracket 30, and the cylindrical portion 32 fits into the first through hole 111*a* of the spout 11. An O-ring is supported inside the first through hole 111*a* of the spout 11, and this O-ring adheres to the outer perimeter of the cylindrical portion 32, thereby making it possible to seal the gas in the spout-equipped packaging bag 10 (not shown). Second through hole 33 penetrates from the top edge of the header portion 31 to the bottom edge of the cylindrical portion 32, and the liquid pouring tube 40 is inserted into the second through hole 33 (see FIG. 2). In order to make it possible to ventilate gas in the spout-equipped packaging bag 10 through a plurality of second orifices 43, a gap is provided between the second through hole 33 and the outer perimeter of the liquid pouring tube 40 (see FIG. 2).

The joint for a container according to the present invention includes a first ventilating means for ventilating air from the inside of the external container 20 to the opening portion 24; a second ventilating means for ventilating air from the inside of the spout-equipped packaging bag 10 to the opening portion 24; and a second cover 60 for sealing the opening portion 24. The first ventilating means has a plurality of first orifices of the joining bracket 30. The plurality of first orifices 35 communicate from the perimeter of the cylindrical portion 32 to the top face 311 of the header portion 31. The second ventilating means has a plurality of second orifices 43. The plurality of second orifices 43 are provided to the collar portion 41 of the liquid pouring tube 40, and communicate the opening portion 24 to the inside of the second through hole 33 of the joining bracket 30 (see FIGS. 2 and 3).

The joint for a container according to the present invention prevents, when the second cover 60 is attached thereto, both liquid and gas from flowing out of the opening portion 24. In addition, when the second cover 60 is removed, the gas in the external container 20 and the gas in the spout-equipped packaging bag 10 escape through the first and second ventilating means, respectively, to the outside of the opening portion 24, before the liquid in the liquid pouring tube 40 is drained to the opening portion 24.

The first orifices 35 may be slits penetrating from the perimeter of the cylindrical portion 32 to the top face 311 of the header portion 31, and are provided between the cylindrical portion 32 and the header portion 31. The first orifices 35 substantially communicate the gap, which is provided between the joining bracket 30 and the spout 11, to atmospheric air (see FIGS. 2 and 3).

As shown in FIG. 2, the second orifices 43 are through holes formed at the collar portion 41 of the liquid pouring tube 40, and penetrate from the top surface of the collar portion 41 to the perimeter of the liquid pouring tube 40. In FIG. 2, the O-ring is supported on the under surface of the collar portion 41, and this O-ring adheres to the top face 311 of the header portion 31, thereby sealing the second through hole 33. The second orifices 43 substantially communicate the gap, which is provided between the inner wall of the second through hole 33 and the external wall of the liquid pouring tube 40, to atmospheric air (see FIG. 3). As explained above, this gap can ventilate the internal space of the spout-equipped packaging bag 10.

Cover

In FIG. 2 or 3, there are provided a first cover 50 that threads together with the opening portion 24 of the external container 20, and a second cover 60 that threads together with the first cover 50.

An internal thread, which threads together with the outer surface of the opening portion 24 of the external container 20, is formed on the internal surface of the first cover 50. A fourth opening 52, the size of which is substantially the same as the external dimension of the joining bracket 30, is concentrically formed to a cover main body 51 that is made of metal or synthetic resin, and a external thread is formed on the outer surface of the cover main body 51. The first cover 50 is threaded together and fastened to the opening portion 24, thereby holding the joining bracket 30.

The second cover 60 is configured with a closure main body 61 which threads together with the first cover 50 provided to the opening portion 24 and which has a light blocking effect, and a bushing 62 which protrudes to the inside of the closure main body 61 and which has an anticorrosion characteristic. The bushing 62 includes an O-ring 63, which adheres to the surface of the collar portion 41 and seals ventilation from the fluid passage 42.

The closure main body 61, made of metal or synthetic resin, is provided with an internal thread on the inner perimeter of the closure main body 61 that threads together with the first cover 50. When the second cover 60 is closed, the inner wall of the closure main body 61 abuts the top face 311 of the joining bracket 30. The closure main body 61 has a light blocking effect so that chemicals accommodated in the spout-equipped packaging bag 10 do not change chemically. Since there is a high possibility for the bushing 62 to contact with the chemicals accommodated in the spout-equipped packaging bag 10, it is preferable that the bushing 62 consists of synthetic resins with corrosion resistance. One end of the bushing 62 is pressed into the closure main body 61, thereby integrating the bushing 62 and the closure main body 61 (see FIG. 3). The other end of the bushing 62 protrudes to the inside of the closure main body 61, thereby supporting the O-ring 63 on the apical surface. The O-ring 63 adheres to the surface of the collar portion 41, thereby preventing both the liquid and gas from flowing out of the fluid passage 42.

Moreover, at least one vent hole 64 is provided to the perimeter of the closure main body 61. Accordingly, when the threads with the first cover 50 are released, the gas in the external container 20 and the gas in the spout-equipped packaging bag 10 escape through the first and second ventilating means, respectively, to the outside of the opening portion 24, before the liquid in the liquid pouring tube 40 is drained to the opening 24 (see FIG. 2 or 3). In this way, the vent holes 64 are provided to the perimeter of the closure main body 61. Accordingly, when the second cover 60 is loosened, the contact of the O-ring 63 to the surface of the collar portion 41 is released, thereby exhausting the gas in at least the plurality of second orifices 43 through the vent holes 64 to the outside. This makes it possible to prevent the liquid in the liquid pouring tube 40 from spouting out.

In FIG. 1 or 2, when the second cover 60 is removed, the gas in the external container 20 and the gas in the spout-equipped packaging bag 10 escape through the first and second ventilating means, respectively, to the outside of the opening portion 24, before the liquid in the liquid pouring tube 40 is drained to the opening portion 24. This makes it possible to prevent the liquid in the liquid pouring tube 40 from being drained to the outside of the opening portion 24.

In the joint for a container according to the present invention, the gas in the liquid pouring tube 40, the gas in the external container 20, and the gas in the spout-equipped packaging bag 10 are individually sealed by the second cover 60. When the second cover 60 is removed, the pressure in the liquid pouring tube 40, the pressure in the external container 20, and the pressure in the spout-equipped packaging bag 10 promptly equilibrate with atmospheric pressure. This makes it possible to prevent the liquid in the liquid pouring tube 40 from being exhausted to the outside of the opening portion 24.

In addition, as shown in FIG. 3, the liquid pouring tube 40 joins a tube 44 in the middle from one end having the collar portion 41 to the other end. It is possible to heat weld the liquid pouring tube 40 to the tube 44 in the middle from one end having the collar portion 41 to the other end, by way of ultrasonic oscillation. In the case of the joint for a container according to the present invention, the liquid pouring tube 40 is integrated into the main body. This makes it possible to save the trouble of eliminating chemicals seeping into the gaps of press fit points of the liquid pouring tube as a conventional separate body.

Accommodation Method

The fluid container 1 of the present invention is inserted into the inside of the external container 20 from the opening portion 24 of the external container 20 as shown in FIG. 6 (*a*). The spout 11 is mounted to the opening portion 24 of the external container 20 as shown in FIG. 6(*b*). In this case, the opening portion 24 of the external container 20 has a substantially cylindrical and protruding shape, and the dimension thereof is shorter than the dimension of the spout engaging portion 11 in the height direction. The flange 112*b* of FIG. 5 abuts the upper perimeter of the step formed on the inner surface of the opening portion 24, thereby supporting the spout-equipped packaging bag 10 in the external container 20.

Subsequently, the fluid content is introduced from the spout 11 in this state with a predetermined method, then the joining bracket 30 is inserted into the spout 11, and the first cover 50 is threaded together with the opening portion 24 to fix the spout 11 and the joining bracket 30, thereby supporting the spout-equipped packaging bag 10. Subsequently, the tube 44 of the liquid pouring tube 40 is inserted into the second through hole 33 of the joining bracket 30 to mount the liquid pouring tube 40, then the second cover 60 is threaded together with the first cover 50, and the top surface of the liquid pouring tube 40 is sealed, thereby covering the opening portion 24. As a result, the opening portion 24 and the spout 11 of the fluid container 1 are sealed, thereby achieving a state in which distribution and transportation are possible.

At the time of using the fluid, namely when the fluid is poured out, it is possible to pour out the fluid from the spout 11 through the liquid pouring tube 40.

In this way, the fluid container of the present invention serves in storing and transporting fluid contents in such technical fields as industrial chemicals, medical and cosmetic raw materials. Above all, a high level of strength and hygiene is required for a resist accommodation container that is repeatedly transported between a resist manufacturer and a manufacturer of devices such as semiconductors. In addition, it is necessary for this transport configuration to cope with various capacities ranging from approximately 1 L to 250 L.

In this regard, the fluid container of the present invention can appropriately cope with various capacities by appropriately selecting an external container and a spout-equipped packaging bag accommodated therein. In addition, since it is easy to attach and detach the spout-equipped packaging bag to and from the external container, working efficiency and hygiene are superior.

EXAMPLES

Hereinafter, the present invention will be explained in more detail by way of Examples; however, the present invention is not limited to these Examples.

Regarding the configuration of the packaging bag to be used for examples and comparative examples to be hereinafter described, a two-layer laminated body consisting of an ON (biaxial stretching polyamide) film (25 μm), a urethane based adhesive (3 μm) and an LLDPE film (40 μm) was used as the outer layer film; a five-level co-extrusion film consisting of an LLDPE layer (25 μm), an adhesive layer (10 μm), a nylon layer (15 μm), an adhesive layer (10 μm) and an LLDPE layer (20 μm) was used as the inner layer film. As the LLDPE film of the outer layer film, a linear low-density polyethylene film polymerized by using metallocene catalyst was used ("SR-UEN" manufactured by DNP Technofilm Co. Ltd.). As the LLDPE layer of the inner layer film, a linear low-density polyethylene resin polymerized by using metallocene catalyst was used ("UMERIT" or UBE super polyethylene manufactured by Ube Industries, Ltd.).

Example 1

As shown in FIG. 4, a spout-equipped packaging bag of the two-layered film and a four sided seal type was manufactured of inside dimensions 380 mm×715 mm, in such a way that the LLDPE layer (25 μm thickness) of the inner layer film faces the content, and a spout made of high density polyethylene is attached to one short side by heat-sealing. The periphery diameter of the flange of the spout engaging portion of the spout made of high density polyethylene was 53.9 mm, the thickness of the flange was 2.5 mm, the periphery diameter immediately under the flange of the spout engaging portion was 50.8 mm, and the height of the spout engaging portion was 32 mm.

Comparative Example 1

As shown in FIG. 4, as a comparative example, a spout-equipped packaging bag of the two-layered film and a four sided seal type was manufactured of inside dimensions 380 mm×715 mm, in such a way that the LLDPE layer (25 μm thickness) of the inner layer film faces the content, and a spout made of high density polyethylene is attached through a hole made in a position of one short side by heat-sealing at the portion of the bottom mounting ring. The periphery diameter of the flange of the spout made of high density polyethylene was 53.9 mm, the thickness of the flange was 2.5 mm, the periphery diameter immediately under the flange was 50.8 mm, and the length between the flange and the bottom mounting ring was 25 mm.

A stainless steel container was prepared, which had a substantially cylindrical shape with a diameter of 227.6 mm, and height of 500 mm, a rim of the bottom, and a cylindrical opening portion with an inner diameter of 50.8 mm and a protruding length of 15.0 mm in the middle portion of the top board. The spout-equipped packaging bag, which was manufactured as described in Example 1 and Comparative Example 1, was inserted from a cylindrical opening portion of the stainless steel container, and was set into a state where the flange abuts the upper perimeter of the step of the cylindrical opening portion. Subsequently, 18 L of water was poured from the spout, and the cylindrical opening portion was appropriately sealed with a sealing means (cover). In such a way, 10 containers serving for a drop test were manufactured for Example 1 and Comparative Example 1, respectively.

The containers that were manufactured as above were each dropped one time in the order of from the height of 70 cm in the order of a vertical direction and a horizontal direction, the existence of water leakage and dented locations were confirmed by visual observation. The results thereof are shown in Table 1.

TABLE 1

| | RESULT OF DROP TEST |
|---|---|
| EXAMPLE 1 | NO BAG BROKEN FOR 10 CONTAINERS |
| COMPARATIVE EXAMPLE 1 | BAG BROKEN FOR 3 OUT OF 10 CONTAINERS (*1) |

(*1) ALL THE BREAKAGES OCCURRED IN A REGION INDICATED BY P IN FIG. 7.

As a result clearly shown in Table 1, the packaging bag may not be broken due to the drop impact in the case of the fluid container accommodating the packaging bag in which the spout was attached to one side of the heat seal portion of Example 1, as compared with the fluid container accommodating the packaging bag in which the spout was attached to a position of the short side of Comparative Example 1.

This result has confirmed that, in the case of the fluid container of the present invention, the packaging bag accommodated in the external container is difficult to break while storing, transporting and handling a liquid such as resist.

Comparative Example 2

A packaging bag that has been conventionally used was prepared with the following configuration as Comparative Example 2. The packaging bag of Example 1 and the packaging bag of Comparative Example 2 were then compared in terms of physical properties, cleanliness, and a leaching degree of particles. The conventional packaging bag has a double-film configuration with an outer layer film and an inner layer film. The outer layer film is a three-layered coextrusion film of PE (15 μm), PE (35 μm) and PE (20 μm). The inner layer film is composed of five films of LLDPE (15 μm), PE (10 μm), NY (20 μm), PE (10 μm) and PE (10 μm) (the content side is LLDPE).

The seal strength of the heat seal portion of the packaging bag, the strength of adhesion between the spout and the packaging bag, the puncture strength and Gelbo resistance of the packaging bag, and the particles were measured for Example 1 and Comparative Example 2 that have been prepared as above, and the results are shown in Table 2. In addition, in terms of a case where the packaging bag was filled with a chemical solution, an amount of minute impure solid matter, an amount of water, an amount of eluted metal impurities, an amount of ion components, an amount of non-volatile components, variation with time in the viscosity of the chemical solution, and a film thickness of a coating formed at the time of applying the chemical solution after a predetermined time has elapsed were measured in the chemical solution, and the results are shown in Table 3. The measurement of various strengths and the like was performed by the following method. Moreover, a photoresist composition (trade name: TFR-790PL, manufactured by Tokyo Ohka Kogyo Corporation) was used as the chemical solution.

Measurement of the Seal Strength

A tension-test piece with a width of 15 mm was collected from a substantially central portion of the heat seal portion except for the heat seal portion in which the spout has been sealed to the packaging bag, and was measured in accordance with JIS-Z1707. It should be noted that the test piece was collected in such a way that the heat seal portion was included at both sides and the middle of the bottom of the heat seal portion 122 of FIG. 4.

Measurement of the Strength of Adhesion Between the Spout and the Packaging Bag Body A test piece with a width of 15 mm was collected in a direction orthogonal to the heat seal portion including the portion in which the spout and the packaging bag body have been heat sealed, and was measured in accordance with JIS-Z1707.

Measurement of the Puncture Strength

The measurement was performed in accordance with "A Testing Method for Apparatus or Container Packaging in General" of the Ministry of Health and Welfare Notification No. 20 in 1982 (Showa 57). The measurement was performed from the inner layer film side and the outer layer film side in a state where the inner layer film and the outer layer film were stacked.

Measurement of Gelbo Resistance

In a state in which the inner layer film and the outer layer film were stacked, Gelbo testing was performed (testing machine: Gelbo Flex Tester), and the number of pin holes was counted for the inner layer film and the outer layer film after performing Gelbo tests for 1,000 times and 2,000 times. The testing was performed in an environment of normal temperature and normal relative humidity.

Measurement of Particles

Ultrapure water was poured into the sample, and the bag was shaken for 10 seconds so that the ultrapure water would spread out in the bag. Subsequently, the bag was left to rest for 20 minutes. The solution to which the process was performed was measured with a particle counter for measuring the number of particles in the solution.

Measurement of an Amount of Minute Impure Solid Matter in the Chemical Solution

The number of the particles was measured by using a particle counter (product name: Particle Sensor KS-41 manufactured by Rion Co., Ltd.).

Measurement of an Amount of Water in the Chemical Solution

It was measured with a Karl-Fischer aquameter.

Measurement of Amount of Eluting Metal Impurities, Amount of Ion Components and Amount of Non-volatile Components in Chemical Solution The amount of eluting metal impurities was measured with an ICP emission spectroscopy photometer. The amount of ion components was measured with ion chromatography. In addition, the amount of non-volatile components corresponds to an increasing weight percentage after evaporation in relation to the initial value.

Measurement of the Viscosity of the Chemical Solution

It was measured with a Cannon-Fenske viscometer.

Measurement of the Film Thickness of the Coat

Spin coating was performed on a 6-inch silicon wafer rpm), the wafer was dried on a hot plate at 190° C. for 90 seconds, and the film thickness of the formed coat was measured.

TABLE 2

| | | | | EXAMPLE 1 | COMPARATIVE EXAMPLE 2 (CONVENTIONAL PRODUCT) |
|---|---|---|---|---|---|
| SEALING STRENGTH (N/15 mm WIDTH) | MEASURED PORTION | $B_1$ | OUTER LAYER/INNER LAYER | 61 | 16 |
| | | | INNER LAYER/INNER LAYER | 76 | 20 |
| | | $B_2$ | OUTER LAYER/INNER LAYER | 65 | 20 |
| | | | INNER LAYER/INNER LAYER | 72 | 22 |
| | | $B_3$ | OUTER LAYER/INNER LAYER | 58 | 15 |
| | | | INNER LAYER/INNER LAYER | 67 | 18 |
| ADHESIVE STRENGTH (N/15 mm WIDTH) | | | | 75.5 | 64.7 |
| PUNCTURE STRENGTH (N/1 mmϕ) | PUNCTURE FROM INNER LAYER SIDE | | | 13.4 | 7.3 |
| | PUNCTURE FROM OUTER LAYER SIDE | | | 10.3 | 7.5 |
| GELBO RESISTANCE (NUMBER OF PIN HOLES) | INNER LAYER | NUMBER OF GELBO: 1000 TIMES | | 9 | 50 |
| | | NUMBER OF GELBO: 2000 TIMES | | 33 | 91 |
| | OUTER LAYE | NUMBER OF GELBO: 1000 TIMES | | 2 | 0 |
| | | NUMBER OF GELBO: 2000 TIMES | | 4 | 13 |
| NUMBER OF PARTICLES (NUMBER/$cm^2$) | PARTICLE DIAMETER: 0.2 μm OR MORE | | | 507 | 716 |
| | PARTICLE DIAMETER: 0.5 μm OR MORE | | | 37 | 68 |

TABLE 3

| ELAPSED MONTHS | | EXAMPLE 1 INITIAL | EXAMPLE 1 ONE MONTH LATER | EXAMPLE 1 THREE MONTHS LATER | COMPARATIVE EXAMPLE 2 (CONVENTIONAL PRODUCT) INITIAL | COMPARATIVE EXAMPLE 2 (CONVENTIONAL PRODUCT) ONE MONTH LATER | COMPARATIVE EXAMPLE 2 (CONVENTIONAL PRODUCT) THREE MONTHS LATER |
|---|---|---|---|---|---|---|---|
| NUMBER OF PARTICLES (NUMBER/ml) | ≦0.20 mm | 58.2 | 50.7 | 56.9 | 129.5 | 44.2 | 57.9 |
| | ≦0.22 mm | 45.0 | 41.4 | 43.6 | 58.0 | 34.4 | 45 |
| | ≦0.25 mm | 27.5 | 29.2 | 25.7 | 38.5 | 23.3 | 27.3 |
| | ≦0.30 mm | 15.9 | 18.9 | 12.5 | 22.5 | 14.5 | 18.4 |
| | ≦0.50 mm | 3.6 | 3.3 | 2.0 | 3.6 | 2.1 | 3.2 |
| VISCOSITY (CP) | | 16.1 | 16.2 | 16.2 | 16.1 | 16.1 | 16.2 |
| FILM THICKNESS(Å) | | 9940 | 10008 | 9957 | 9940 | 9996 | 9958 |
| WATER AMOUNT (%) | | 0.05 | 0.12 | 0.08 | 0.05 | 0.09 | 0.10 |
| METAL IMPURITIES | Na | 1 ppb OR LESS | 1 ppb OR LESS | | 1 ppb OR LESS | 1 ppb OR LESS | |
| | K | 1 ppb OR LESS | 1 ppb OR LESS | | 1 ppb OR LESS | 1 ppb OR LESS | |
| | Fe | 1 ppb OR LESS | 1 ppb OR LESS | | 1 ppb OR LESS | 1 ppb OR LESS | |
| | Ca | 1 ppb OR LESS | 1 ppb OR LESS | | 1 ppb OR LESS | 1 ppb OR LESS | |
| | Mg | 1 ppb OR LESS | 1 ppb OR LESS | | 1 ppb OR LESS | 1 ppb OR LESS | |
| | Mn | 1 ppb OR LESS | 1 ppb OR LESS | | 1 ppb OR LESS | 1 ppb OR LESS | |
| | Cu | 1 ppb OR LESS | 1 ppb OR LESS | | 1 ppb OR LESS | 1 ppb OR LESS | |
| | Cr | 1 ppb OR LESS | 1 ppb OR LESS | | 1 ppb OR LESS | 1 ppb OR LESS | |
| | Ni | 1 ppb OR LESS | 1 ppb OR LESS | | 1 ppb OR LESS | 1 ppb OR LESS | |
| | Al | 1 ppb OR LESS | 1 ppb OR LESS | | 1 ppb o OR LESS | 1 ppb OR LESS | |
| | Si | 50 ppb OR LESS | 50 ppb OR LESS | | 50 ppb OR LESS | 50 ppb OR LESS | |
| ION CHROMATOGRAPHY (IC) | | — | NO PROBLEMS | | — | NO PROBLEMS | |
| NON-VOLATILE COMPONENTS | | — | 4.9 ppm OR LESS | | — | 4.9 ppm OR LESS | |

As a shown in Table 2, the results are that the packaging bag of Example 1 was superior to the packaging bag of Comparative Example 2 in terms of the seal strength of the heat seal portion, the strength of adhesion between the spout and the packaging bag, and the puncture strength of the packaging bag. Moreover, the number of pin holes and the number of particles were smaller.

In addition, in the case where the packaging bag was filled with the chemical solution as shown in Table 3, the result of Example 1 was substantially the same as the result of Comparative Example 2 in terms of the change of the eluting degrees of particles, metal impurities, ion components, and non-volatile components into the chemical solution, as well as the viscosity of the chemical solution, and the amount of water.

These results have confirmed that the packaging bag of the present invention is superior in mechanical strength, and is difficult to break during storage, transportation and handling of contents such as resist liquid, and particles and the like are not likely to elute into the chemical solution.

The invention claimed is:

1. A fluid container comprising:

an external container having a threaded neck;

an internal bag disposed within an interior of the external container, the internal bag comprising:

a flexible body;

an upper opening;

a heat sealed perimeter closing the bag body and having a tapered portion surrounding the upper opening;

a spout having a cylindrical neck and flared tabs sealed to the tapered portion of the heat sealed perimeter, and the spout fitted into the threaded neck of the external container;

a boss fitted into the spout of internal bag; and, a cover fastened to the threaded neck of the external container for securing the boss to the spout of the internal bag and to the threaded neck of the external container.

2. The fluid container according to claim 1, wherein the spout is configured to support the internal bag by being engaged with an opening portion of the external container.

3. The fluid container according to claim 1, wherein the spout is made of synthetic resin that is bondable to the tapered portion of the heat sealed perimeter.

4. The fluid container according to claim 1, wherein the spout is fluorinated resin, and the flexible body is fluorinated resin.

5. The fluid container according to claim 1, wherein said internal bag accommodates an amount of a resist liquid.

6. The fluid container according to claim 5, wherein the amount of the resist liquid is in a range of 1 liter to 250 liters.

7. The fluid container according to claim 1, wherein the spout is polyethylene, and the flexible body is polyethylene.

8. The fluid container according to claim 7, wherein the polyethylene of the flexible body is linear low-density polyethylene polymerized by a metallocene catalyst.

9. The fluid container according to claim 1, wherein the external container is a repeatedly usable rigid container.

10. The fluid container according to claim 9, wherein the rigid container is a metal container or a synthetic resin container.

11. The fluid container according to claim 9, wherein the external container enables the upper opening to be sealed.

12. The fluid container according to claim 1, wherein the internal bag is configured with multilayered films, each of which is made of at least a stacked outer layer film and an inner layer film, wherein the multilayered films are stacked so that the inner layer films face each other, and wherein a portion of the heat sealed perimeter is formed at an outer periphery of the multilayered films.

13. The fluid container according to claim 12, wherein the inner layer film is a coextrusion film in which a polyamide layer is a core layer, and wherein a thermobonding resin layer is respectively formed on both faces of the core layer via an adhesive layer.

14. The fluid container according to claim 12, wherein the outer layer film is a laminated film, in which a thermobonding resin layer is formed on one face of a biaxial stretching polyamide film with an adhesive.

15. The spout-equipped packaging bag according to claim 12, wherein the internal bag is formed so that internal corners of the heat sealed perimeter are arc-shaped.

* * * * *